US011177106B2

(12) United States Patent
Lee et al.

(10) Patent No.: US 11,177,106 B2
(45) Date of Patent: Nov. 16, 2021

(54) MINIATURIZED X-RAY TUBE INCLUDING EXTRACTOR

(71) Applicant: RE-MEDI CO., LTD, Chuncheon-si (KR)

(72) Inventors: Re Na Lee, Seoul (KR); Suk Young Shin, Seoul (KR); Hyun Jin Kim, Seoul (KR)

(73) Assignee: RE-MEDI CO., LTD, Chuncheon-si (KR)

( * ) Notice: Subject to any disclaimer, the term of this patent is extended or adjusted under 35 U.S.C. 154(b) by 0 days.

(21) Appl. No.: 16/642,370

(22) PCT Filed: Nov. 28, 2019

(86) PCT No.: PCT/KR2019/016586
§ 371 (c)(1),
(2) Date: Feb. 26, 2020

(87) PCT Pub. No.: WO2020/111820
PCT Pub. Date: Jun. 4, 2020

(65) Prior Publication Data

US 2021/0151274 A1 May 20, 2021

(30) Foreign Application Priority Data

Nov. 28, 2018 (KR) ..... 10-2018-0149911

(51) Int. Cl.
*H01J 35/14* (2006.01)
*H01J 35/06* (2006.01)
(Continued)

(52) U.S. Cl.
CPC ..... *H01J 35/14* (2013.01); *H01J 35/045* (2013.01); *H01J 35/066* (2019.05); *H05G 1/34* (2013.01); *H01J 35/32* (2013.01)

(58) Field of Classification Search
CPC ..... H01J 35/14; H01J 35/045; H05G 1/34
See application file for complete search history.

(56) References Cited

U.S. PATENT DOCUMENTS 3,452,232 A * 6/1969 Seki et al. ..... H01J 35/066 378/41
6,134,300 A * 10/2000 Trebes ..... H01J 35/32 378/121
(Continued)

FOREIGN PATENT DOCUMENTS

JP 2008-234907 A 10/2008
JP 2017-183028 A 10/2017
(Continued)

OTHER PUBLICATIONS

Hye Ryun Park, "Written Opinion for International Application No. PCT/KR2019-016586", dated Mar. 19, 2020, KIPO, Korea.

*Primary Examiner* — Chih-Cheng Kao
(74) *Attorney, Agent, or Firm* — Novick, Kim & Lee, PLLC; Jae Youn Kim

(57) ABSTRACT

Provided is a miniaturized X-ray tube including an extractor and provides a miniaturized X-ray tube including a filament that emit electrons if a voltage is applied, a base having two filament through-holes for fixing the filament and for connecting power to both electrodes of the filament, a cylindrical extractor in close contact with the base and surrounding the filament without being in contact with the filament, a cutoff voltage providing unit configured to apply a cutoff voltage between one electrode of the extractor and one electrode of the filament, a body that is formed of a ceramic material, surrounds the extractor, and includes one end in close contact with the base, and a target that is connected to the other end of the body, receives the electrons emitted from the filament, and emits X-rays.

4 Claims, 2 Drawing Sheets

(51) Int. Cl.

| | |
|---|---|
| ***H01J 35/04*** | (2006.01) |
| ***H05G 1/34*** | (2006.01) |
| *H01J 35/32* | (2006.01) |

(56) References Cited

U.S. PATENT DOCUMENTS

| | | | | |
|---|---|---|---|---|
| 2017/0372863 | A1* | 12/2017 | Price | H01J 35/147 |
| 2018/0350550 | A1* | 12/2018 | Terletska | H01J 35/06 |

FOREIGN PATENT DOCUMENTS

| | | | | |
|---|---|---|---|---|
| KR | 10-1506265 | B1 | | 3/2015 |
| KR | 2015-0057970 | A | | 5/2015 |
| KR | 10-1754780 | B1 | | 7/2017 |
| KR | 20180046959 | A | * | 5/2018 |
| KR | 10-1915523 | B1 | | 11/2018 |

* cited by examiner

MINIATURIZED X-RAY TUBE INCLUDING EXTRACTOR

TECHNICAL FIELD

The present disclosure relates to a miniaturized X-ray tube, and more particularly, to a miniaturized X-ray tube including an extractor that may control a form of emission of electrons emitted from a filament and control emission of X-rays by using a cutoff voltage.

BACKGROUND ART

Among technologies for diagnosing disease of a patient, an X-ray technology capable of imaging an inside of a human body of the patient is increasingly used. Particularly, in the related art, it was possible to image only a large part such as the chest, arms, and legs due to a size of an X-ray imaging device, but X-ray imaging of a small part of a human body is required in dental treatment and so on, and thus, an X-ray tube needs to be miniaturized.

Korean Patent No. 10-1915523 entitled "X-RAY TUBE", which is related art, describes a basic form of a miniaturized X-ray tube and describes a structure in which, if an emitter emits electrons, the electrons collide with an anode electrode to cause X-rays to be emitted therefrom.

However, the X-ray tube according to the related art has a problem that, when a voltage is applied to an emitter for emitting electrons, a preheating time is required, and a subject is exposed to X-rays during that time until a necessary X-ray image is obtained.

Accordingly, there is a need for a structure in which a miniaturized X-ray tube may be controlled to emit electrons only at the moment for obtaining an X-ray image.

DESCRIPTION OF EMBODIMENTS

Technical Problem

An object of the present disclosure is to provide a miniaturized X-ray tube that easily performs X-ray imaging of a small area.

In addition, another object of the present disclosure is to provide an X-ray tube that controls emission of electrons until a voltage is applied to a filament to cause electrons of a necessary level to be emitted, thereby, minimizing exposure to X-rays.

In addition, another object of the present disclosure is to provide an X-ray tube that may obtain a clear X-ray image by minimizing a focus area of electrons reaching a target.

In addition, another object of the present disclosure is to prevent a tube from being damaged due to heat by forming a material of an extractor connected to a body formed of a ceramic material as ceramic and a material having a thermal expansion coefficient similar to a thermal expansion coefficient of the ceramic.

Solution to Problem

In order to achieve the object, an X-ray tube according to an embodiment of the present disclosure is configured to include a filament that emit electrons if a voltage is applied, a base having two filament through-holes for fixing the filament and for connecting power to both electrodes of the filament, a cylindrical extractor in close contact with the base and surrounding the filament without being in contact with the filament, a cutoff voltage providing unit configured to apply a cutoff voltage between one electrode of the extractor and one electrode of the filament, a body that is formed of a ceramic material, surrounds the extractor, and includes one end in close contact with the base, and a target that is connected to the other end of the body, receives the electrons emitted from the filament, and emits X-rays.

At this time, the cutoff voltage providing unit may apply a cutoff voltage between the extractor and the one electrode of the filament, and may block the cutoff voltage after a predetermined preheating time elapses from a time point when a voltage is applied between the both electrodes of the filament.

In addition, the cutoff voltage providing unit may apply a voltage higher than or equal to 200 V or lower than or equal to 300 V between the one electrode of the extractor and the one electrode of the filament.

In addition, the extractor may be formed of ceramic configuring the body and a metal having a thermal expansion coefficient within a predetermined range.

At this time, the extractor may be formed of kovar

Advantageous Effects of Disclosure

According to the present disclosure, a miniaturized X-ray tube is provided, and thus, there is an effect that X-ray imaging of a small area is easily performed.

In addition, according to the present disclosure, a voltage is applied to a filament in an x-ray tube to control emission of electrons until electrons of a necessary level are emitted, and thus, there is an effect that exposure to X-rays may be minimized.

In addition, according to the present disclosure, a focus area of electrons reaching a target is minimized in an X-ray tube, and thus, there is an effect that a clear X-ray image may be obtained.

In addition, according to the present disclosure, a material of an extractor connected to a body formed of a ceramic material is formed of a material having a thermal expansion coefficient similar to a thermal expansion coefficient of ceramic, and thus, a tube is prevented from being damaged due to heat.

BEST MODE

In order to achieve the objects, an X-ray tube according to an embodiment of the present disclosure is configured to include a filament that emit electrons if a voltage is applied, a base having two filament through-holes for fixing the filament and for connecting power to both electrodes of the filament, a cylindrical extractor in close contact with the base and surrounding the filament without being in contact with the filament, a cutoff voltage providing unit configured to apply a cutoff voltage between one electrode of the extractor and one electrode of the filament, a body that is formed of a ceramic material, surrounds the extractor, and includes one end in close contact with the base, and a target that is connected to the other end of the body, receives the electrons emitted from the filament, and emits X-rays.

At this time, the cutoff voltage providing unit may apply a cutoff voltage between the extractor and the one electrode of the filament, and may block the cutoff voltage after a predetermined preheating time elapses from a time point when a voltage is applied between the both electrodes of the filament.

In addition, the cutoff voltage providing unit may apply a voltage higher than or equal to 200 V or lower than or equal to 300 V between the one electrode of the extractor and the one electrode of the filament.

In addition, the extractor may be formed of ceramic configuring the body and a metal having a thermal expansion coefficient within a predetermined range.

At this time, the extractor may be formed of kovar.

MODE OF DISCLOSURE

Hereinafter, preferred embodiments of the present disclosure will be described in detail with reference to the accompanying drawings. In describing the present disclosure, when it is determined that specific description of the related well-known configuration or function may obscure the gist of the present disclosure, the detailed description thereof will be omitted. In addition, in describing the embodiments of the present disclosure, specific numerical values are only examples, and the scope of the present disclosure is not limited thereto.

Figure 1:
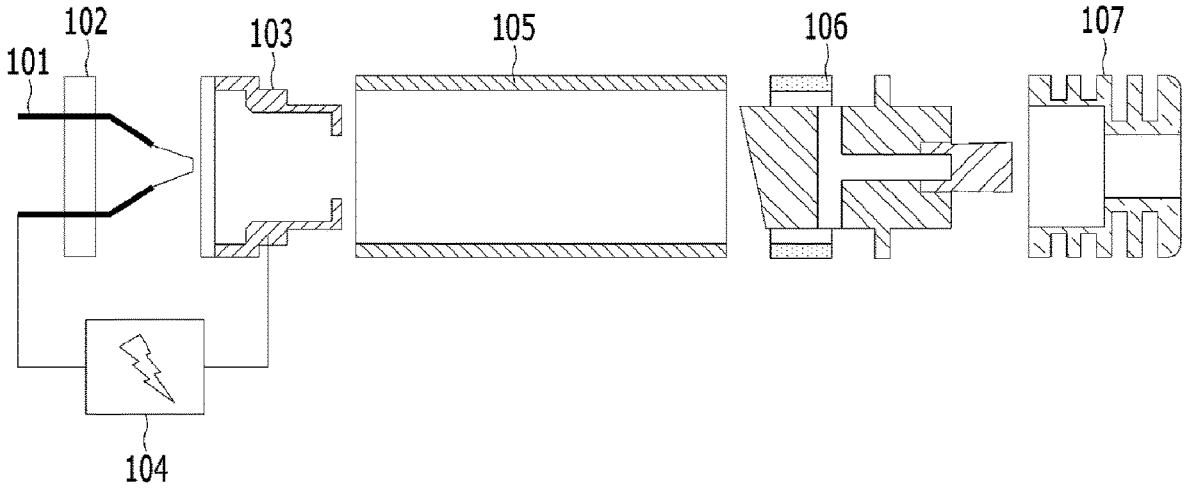
FIG. 1 is a view illustrating a configuration of a miniaturized X-ray tube according to an embodiment of the present disclosure.

FIG. 1 is a view illustrating a configuration of a miniaturized X-ray tube according to an embodiment of the present disclosure.

As illustrated in the figure, the miniaturized X-ray tube according to the embodiment of the present disclosure may be configured with a filament 101, a base 102, an extractor 103, a cutoff voltage providing unit 104, a body 105, a target 106, and a heat dissipation cap 107.

The filament 101 emits electrons when a voltage is applied thereto. When the filament 101 is heated by being energized to exceed a certain temperature, the filament 101 starts to emit electrons. The miniaturized X-ray tube according to the exemplary embodiment of the present disclosure uses a basic principle in which the electrons emitted from the filament 101 are rapidly moved toward the target 106 by using a high voltage applied between the filament and the target 106 and the moved electrons collide with the target 106 to generate an X-ray.

A portion that functions to generate electrons, such as the filament 101, is called an emitter or a cathode, and if the portion serves to emit the electrons without being limited by such a term, it may be understood to have the same technical scope as the filament 101 in the present disclosure.

As described above, if heat is generated by electricity and the heat exceeds a critical point, the filament 101 emits electrons and, a preheating time for preheating is required until the heat reaches a predetermined temperature or more. Accordingly, the conventional X-ray tube has a problem that X-rays with a dose not enough for capturing an X-ray image is emitted until power is applied and preheating of the filament is completed, and thereby, an inspector or a patient is exposed to radiation.

Since the filament 101 operates when a voltage is applied, it is apparent that a power supply module for applying a voltage to the filament is connected, and X-ray imaging may be controlled by supplying and blocking power through the power supply module.

The base 102 includes two filament through-holes for fixing the filament 101 and connecting power to both electrodes of the filament 101. Electrons generated by the filament 101 move in a direction of the target 106 due to a high voltage, and to this end, the filament 101 has to be fixed constantly inside the X-ray tube and an opposite direction of the target 106 needs to be blocked. In addition, the filament 101 has to be able to supply power to the filament 101 from the outside while being inside the X-ray tube.

Accordingly, the base 102 may be configured to fix the filament by fitting thereinto and may include through-holes for enabling the two electrodes of the filament 101 to protrude outside the X-ray tube to be connected to the power supply module.

The extractor 103 is in close contact with the base 102 and surrounds the filament without being in contact with the filament 101. The extractor is formed of a metal and surrounds the filament 101, which may affect movement of electrons when the electrons emitted from the filament 101. Accordingly, which position of the target 106 the emitted electrons will be focused to may be determined according to an internal inclination of the extractor 103, a size of the hole, and so on.

Accordingly, by adjusting a shape of the extractor 103, it is possible to differently form a mode for generating the X-rays, and by integrating a focus area, it is possible to increase sharpness of the X-ray image.

Particularly, the extractor 103 is not in contact with the filament 101, and thus, when a voltage is applied between the filament 101 and the extractor 103, an electric field is generated in a space therebetween, and electrons generated by the filament 101 may not be emitted to the outside by using the electric field, and thereby, it is possible to prevent the X-rays from being emitted from the target 106. As described above, after exceeding a threshold temperature, the filament 101 emits normally the electrons, thereby, requiring preheating time, and the related art has a problem that electrons generated little by little during the preheating time collide with a target to generate X-rays, and thus, an inspector or a patient may be exposed to unnecessary X-rays, but in the present disclosure, if an electric field is generated by applying a cutoff voltage between the extractor 103 and the filament 101 as described above, emission of the electrons is blocked, and thus, X-rays may be controlled to generate electrons only when the electrons are really required.

The extractor 103 has to be formed of a metal material such that a high voltage is applied thereto, and as illustrated in the figure, the extractor 103 has to be in close contact with the body formed of a ceramic material to make an internal space to be vacuum, and in consideration of characteristics of the X-ray tube that may generate a high heat, it is preferable to use a material having a thermal expansion coefficient similar to a thermal expansion coefficient of the ceramic to prevent an impact caused by a difference in the thermal expansion coefficient from being generated during heating. Such a material is kovar (kovar) which is a Fernico-based alloy composed of Fe 54%, Ni 29%, and Co 17% and is a material widely used for a portion being sutured with glass or ceramic because the kovar has a thermal expansion coefficient thereof is similar to the thermal expansion coefficient of hard glass and has no difference from ceramic.

The cutoff voltage providing unit 104 applies a cutoff voltage between one electrode of the extractor 103 and one electrode of the filament 101. As described above, if a voltage is applied between the filament 101 and the extractor 103, an electric field is formed between the filament and the extractor to prevent the electrons emitted from the filament 101 from moving to the target 106. As described above, a voltage for blocking emission of electrons is called a cutoff voltage in the present disclosure, and the cutoff voltage providing unit 104 functions to apply such cutoff a voltage between the filament 101 and the extractor 103.

As described above, if the cutoff voltage is applied, it is possible to control emission of the electrons from the filament 101 toward the target 106, and the cutoff voltage may be applied to block the emission of electron when the X-ray need not be unnecessarily emitted, such as when the filament 101 is preheated or when waiting for a high voltage to be applied between the filament 101 and the target 106.

To this end, the cutoff voltage providing unit 104 applies the cutoff voltage between one electrode of the extractor 103 and one electrode of the filament 101, and when a voltage is applied between both electrodes of the filament 101 and preheating time elapses to enable electrons be emitted to the extent that X-rays may be imaged, the cutoff voltage providing unit 104 may block the cutoff voltage so that the X-rays are emitted. With this configuration, unnecessary X-rays generated during the preheating time may be blocked in advance, and thereby, it is possible to obtain an effect that exposure to X-ray may be minimized.

The cutoff voltage providing unit 104 may apply a voltage between 200 V and 300 V as a cutoff voltage applied as such, which corresponds to a voltage for forming an electric field that may block an outflow of electrons emitted from the filament 101, and the voltage may change depending on a structure and a material of the extractor 103.

The body 105 surrounds the extractor 103, and one end of the body 105 is in close contact with the base, and the body 105 is formed of a ceramic material. An inside of the X-ray tube is a vacuum so that the electrons may move without resistance, and to this end, the body 105 wrapping around the entire X-ray tube including the filament 101 and the target 106 is required.

Since electrons move and X-rays are emitted inside the body 105, the body 105 is preferably formed of a ceramic material so that the applied high voltage may be insulated without affecting the movement of electrons, and a metal portion in contact with the body 105 formed of the ceramic material is preferably formed of a material having a thermal expansion coefficient similar to the thermal expansion coefficient of the ceramic material, such as kovar (kovar) so as to resist high heat.

The target 106 is connected to the other end of the body 105, receives electrons emitted from the filament 101, and emits X-rays. The target 106 is preferably formed of a metal material such as copper, and may generate the X-rays to be provided to a portion where the X-rays are required by using a phenomenon that the X-rays are generated when the electrons moving at high speed due to a high voltage collide with a metal surface.

The target 106 is also called an anode and may be configured to enable the X-rays to be emitted in the corresponding direction by having a shape inclined in a direction in which the X-rays have to be emitted when the electrons emitted from the filament 101 collide with each other, as illustrated in the figure. X-ray emission form of the same electrons may change depending on a structure, an inclination, a material, and so on of the target 106, and thus, different structures according to an application method of the X-rays may be provided.

The heat dissipation cap 107 is connected to the target 106 to dissipate heat. As described above, electrons generated by the filament 101 reaches the target 106 and collides with each other, and thereby, X-rays are generated, and in this process, heat is generated due to an effect of the collision. Particularly, when a miniaturized X-ray device, not a large X-ray device, emits X-rays with high energy, a large amount of heat is generated in a narrow target area, which may cause deformation of an apparatus or affect performance.

Accordingly, the heat dissipation cap 107 is connected to the target 106 in which a lot of heat is generated and serves to quickly dissipate the heat of the target 106. To this end, the heat dissipation cap 107 is preferably formed of a metal material having high electrical conductivity, and an external surface of the heat dissipation cap 107 is formed to have wrinkles to maximize an area for dissipating heat, and thus, heat dissipation efficiency may be increased.

The heat dissipation cap 107 may be preferably formed of the same material as the target to quickly dissipate heat from the target 106, and a metal such as copper that facilitates emission of X-rays may be used as the material.

Figure 2:
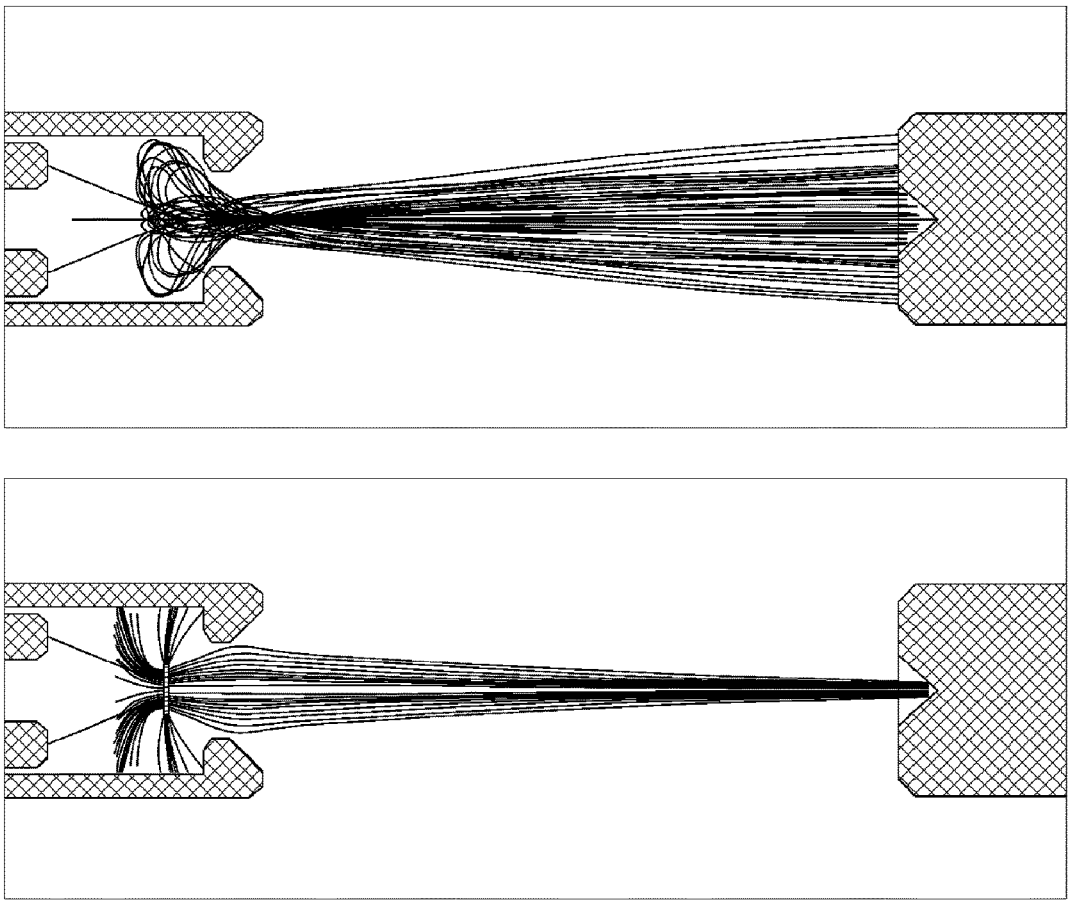
FIG. 2 shows views illustrating an extractor of the miniaturized X-ray tube according to the embodiment of the present disclosure.

FIG. 2 shows views illustrating the extractor of the miniaturized X-ray tube according to the embodiment of the present disclosure.

As illustrated in the views, a movement path of electrons generated by the filament 101 to the target 106 may completely change depending on a shape and voltage of the extractor 103 in the X-ray tube. Generally, in order to obtain a clear X-ray image, a high voltage is applied or emission of electrons for generating X-rays has to be concentrated in a narrow focus area, and by adjusting a shape of an electron beam emitted from the filament 101 by controlling a structure and a voltage of the extractor 103, it is possible to obtain a clearer X-ray image even by the same operation voltage.

In the views, the upper view illustrates a case in which electrons emitted from the filament 101 do not converge to a focal point and spread, and in this case, it is difficult to obtain a clear X-ray image. If the electrons are focused on a point of the target 106 as illustrated in the lower view, a high dose of X-rays may be emitted at a target point for imaging, and thus, a clearer X-ray image may be obtained.

Figure 3:
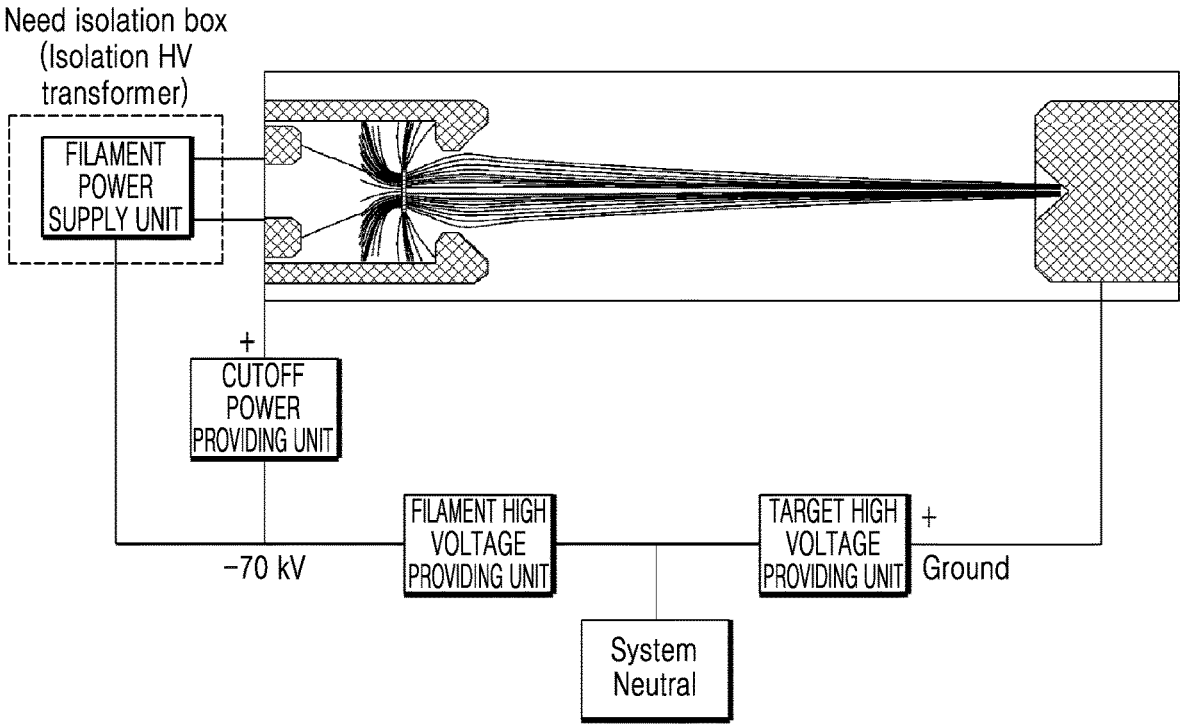
FIG. 3 is a configuration diagram illustrating a voltage application module of the miniaturized X-ray tube according to the embodiment of the present disclosure.

FIG. 3 is a configuration diagram illustrating a voltage application module of the miniaturized X-ray tube according to the embodiment of the present disclosure.

As illustrated in the figure, basically, the miniaturized X-ray tube according to the present disclosure is configured to heat the filament by using a voltage of a filament power supply unit for applying a voltage to the filament 101, and the electrons generated in this process moves in direction of the target 106.

At this time, a high voltage difference is formed between the filament 101 and the target 106 due to a filament high voltage providing unit and a target high voltage providing unit, and the target 106 becomes an anode to cause electrons generated by the filament 101 to quickly move toward the target 106. A voltage between the filament 101 and the target 106 may be a high voltage of approximately 70 kV, which may change depending on a usage of the X-rays.

In the present disclosure, a cutoff voltage providing unit for adding a voltage to the extractor 103 is included therein, and a cutoff voltage is applied between one electrode of the filament 101 and the extractor 103, and thereby, it is possible to serve as a switch by preventing electrons generated by the filament 101 from moving toward the target 106.

Figure 4:
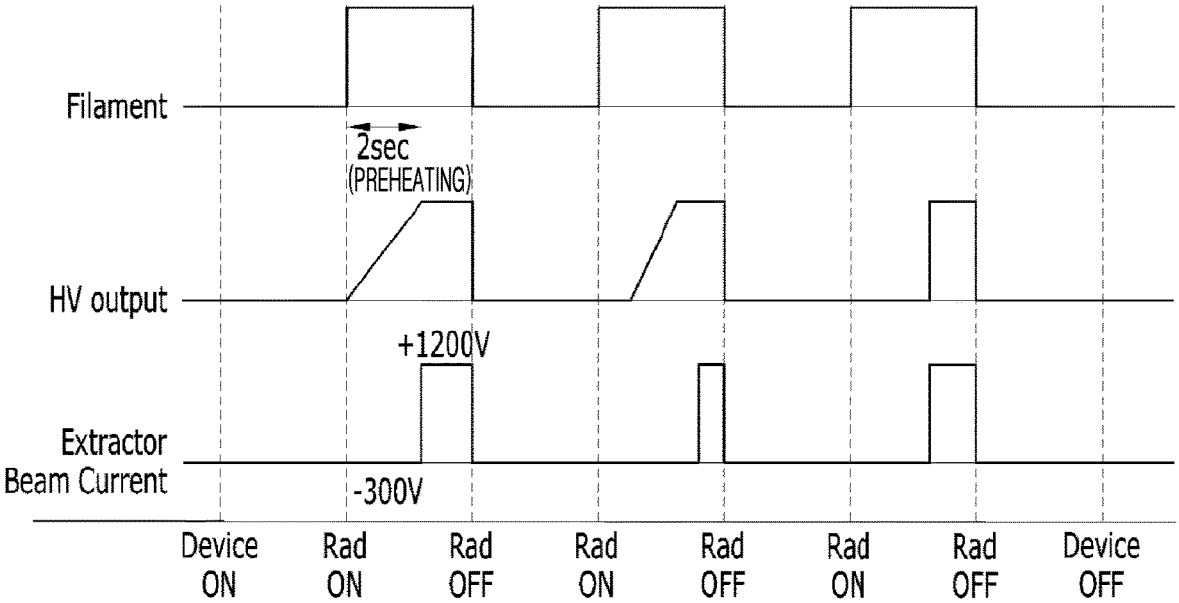
FIG. 4 is a diagram illustrating an operation of the miniaturized X-ray tube according to the embodiment of the present disclosure.

FIG. 4 is a diagram illustrating an operation of the miniaturized X-ray tube according to the embodiment of the present disclosure.

As illustrated in the figure, when a voltage is applied to the filament 101, the filament 101 requires a preheating time until heating starts to reach a temperature at which electrons are emitted. Preheating time of approximately 2 seconds is required as illustrated in the example of the figure, and at this time, there may be a problem that X-rays are unnecessarily emitted while a small amount of electrons are emitted.

A high voltage between the filament 101 and the target 106 may also take time to reach a target voltage, and there is no method for blocking unnecessarily generated X-rays in this process in the related art. However, it is possible to configure a system in which, if a cutoff voltage is applied to the extractor 103 like the X-ray tube according to the present disclosure, emission of electrons may be precisely controlled based on the cutoff voltage, and thereby, the X-rays may be emitted only when necessary.

Although above description is made with reference to the embodiments, those skilled in the art may variously modify and change the present disclosure without departing from the spirit and scope of the present disclosure described in the claims below.

INDUSTRIAL APPLICABILITY

The present disclosure relates to a miniaturized X-ray tube including an extractor and provides a miniaturized X-ray tube including a filament that emit electrons if a voltage is applied, a base having two filament through-holes for fixing the filament and for connecting power to both electrodes of the filament, a cylindrical extractor in close contact with the base and surrounding the filament without being in contact with the filament, a cutoff voltage providing unit configured to apply a cutoff voltage between one electrode of the extractor and one electrode of the filament, a body that is formed of a ceramic material, surrounds the extractor, and includes one end in close contact with the base, and a target that is connected to the other end of the body, receives the electrons emitted from the filament, and emits X-rays.

The invention claimed is:

1. A miniaturized X-ray tube comprising:

a filament that emits electrons when a voltage is applied thereto;

a base having two filament through-holes for fixing the filament and for connecting power to two electrodes of the filament;

a cylindrical extractor in contact with the base and surrounding the filament without being in contact with the filament;

a cutoff voltage providing unit configured to apply a cutoff voltage between one electrode of the extractor and one of the two electrodes of the filament;

a body that is formed of a ceramic material, surrounds the extractor, and includes one end in contact with the extractor;

a target that is connected to another end of the body, receives the electrons emitted from the filament, and emits X-rays;

wherein the X-ray tube is configured to form a voltage difference according to purposes of the X-rays between the filament and the target when the filament emits the electrons, wherein the cutoff voltage providing unit blocks the cutoff voltage after a predetermined preheating time elapses from a time point when a voltage is applied between the two electrodes of the filament, and wherein the predetermined preheating time is a preheating time of the filament, which enables the electrons to be emitted to an extent that the X-rays are imaged.

2. The miniaturized X-ray tube of claim 1, wherein the cutoff voltage providing unit applies a voltage higher than or equal to 200 V or lower than or equal to 300 V between the one electrode of the extractor and the one electrode of the filament.

3. The miniaturized X-ray tube of claim 1, wherein the extractor is formed of ceramic configuring the body and a metal having a thermal expansion coefficient within a predetermined range.

4. The miniaturized X-ray tube of claim 1, wherein the extractor is formed of kovar.

* * * * *